US010729943B2

(12) United States Patent
Schwenger et al.

(10) Patent No.: US 10,729,943 B2
(45) Date of Patent: Aug. 4, 2020

(54) GROMMET AND GROMMET STRIP FOR BALL GAME RACKET

(71) Applicant: Head Technology GmbH, Kennelbach (AT)

(72) Inventors: Ralf Schwenger, Weiler-Simmerberg (DE); Harald Rosenkranz, Lauterach (AT)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 16/383,817

(22) Filed: Apr. 15, 2019

(65) Prior Publication Data

US 2019/0321693 A1 Oct. 24, 2019

(30) Foreign Application Priority Data

Apr. 19, 2018 (DE) ..... 10 2018 003 690

(51) Int. Cl.
*A63B 49/02* (2015.01)
*A63B 49/022* (2015.01)

(52) U.S. Cl.
CPC ..... *A63B 49/022* (2015.10)

(58) Field of Classification Search
CPC .... A63B 49/022; A63B 49/025; A63B 49/028
See application file for complete search history.

(56) References Cited

U.S. PATENT DOCUMENTS 4,930,778 A * 6/1990 Mizuno ..... A63B 49/022 473/540
RE34,420 E * 10/1993 Darling ..... A63B 49/028 473/522
5,332,213 A * 7/1994 Klose ..... A63B 49/022 473/522
5,833,560 A * 11/1998 Davis ..... A63B 49/00 473/537
5,944,624 A * 8/1999 Davis ..... A63B 49/022 473/522
5,993,337 A * 11/1999 Janes ..... A63B 49/14 473/539
6,050,909 A * 4/2000 Severa ..... A63B 49/022 473/524
6,074,315 A * 6/2000 Yimoyines ..... A63B 51/00 473/539
6,217,466 B1 * 4/2001 Yimoyines ..... A63B 51/00 473/539
7,371,197 B1 * 5/2008 Yu ..... A63B 49/022 473/521
7,887,444 B1 * 2/2011 Severa ..... A63B 49/10 473/539
9,302,159 B2 * 4/2016 Schwenger ..... A63B 51/00
(Continued)

FOREIGN PATENT DOCUMENTS

DE 102013018837 B3 * 2/2015 ..... A63B 49/022
EP 3 132 832 A1 2/2017
WO WO-2015177937 A1 * 11/2015 ..... A63B 49/022

*Primary Examiner* — Raleigh W Chiu
(74) *Attorney, Agent, or Firm* — Bookoff McAndrews, PLLC

(57) ABSTRACT

The present invention relates to a grommet and a grommet strip for a ball game racket as well as to a specific ball game racket for receiving the grommet according to the invention or the grommet strip according to the invention.

20 Claims, 6 Drawing Sheets

(56) References Cited

U.S. PATENT DOCUMENTS

| | | | | |
|---|---|---|---|---|
| 10,004,950 | B1 * | 6/2018 | Kapheim | A63B 49/022 |
| 2001/0041632 | A1 * | 11/2001 | Bertolotti | A63B 51/02<br>473/543 |
| 2009/0165243 | A1 * | 7/2009 | Yazdi | A63B 51/14<br>16/2.1 |
| 2014/0296005 | A1 * | 10/2014 | Yamamoto | A63B 49/035<br>473/519 |
| 2015/0157902 | A1 * | 6/2015 | Mohr | A63B 49/022<br>473/539 |
| 2019/0321693 | A1 * | 10/2019 | Schwenger | A63B 51/00 |

* cited by examiner

GROMMET AND GROMMET STRIP FOR BALL GAME RACKET

This patent application claims the benefit under 35 U.S.C. 119 to German Patent Application No. 10 2018 003 690.2, filed on Apr. 19, 2018, the entirety of which is incorporated herein by reference.

The present invention relates to a grommet and a grommet strip for a ball game racket as well as to a specific ball game racket for receiving the grommet and/or grommet strip according to the invention.

Ball game rackets normally comprise a racket frame with a racket head or head portion for receiving a stringing as well as a handle portion for holding the ball game racket. A heart region comprising a bridge and two arms can be provided between the handle portion and the head portion. As a rule, the stringing is formed by a plurality of longitudinal strings and transverse strings, wherein technically speaking normally only two long strings (typically having a length of approx. 6 to 6.5 m) or a very long string (typically having a length of approx. 11 to 12 m) is/are passed through a plurality of string openings, mostly bores, in the racket head in such a manner that a stringing pattern of transverse strings (transverse string portions) and longitudinal strings (longitudinal string portions) is formed. The strings are normally passed through grommets that are introduced in the string openings in the racket head. Optionally, there is provided a so-called grommet strip on which multiple grommets are provided. In the ready-to-play state, these grommets then extend through the string openings in the racket head and the grommet strip forms a portion of a circumferential surface of the racket head. An example of a grommet strip is shown in EP 3 132 832 A1.

The playing characteristics of the racket are not only determined by the mechanical characteristics of the frame itself but, i.a., also by the stringing, in particular the vibration behavior of the stringing. Normally, the vibration behavior of the string of a racket can be influenced in that, apart from using a different string type, a different tensioning of the stringing is used.

Therefore, it is an object of the present invention to provide a ball game racket frame in which the vibration behavior of the stringing can be influenced in an improved manner.

This object is achieved by a ball game racket frame according to the attached claims. Preferred embodiments of the ball game racket according to the invention are described in the dependent claims.

The present invention accordingly relates, i.a., to a ball game racket frame which defines a string bed plane and comprises at least one string opening for receiving a string, wherein the string opening comprises a grommet with a string channel, wherein the string channel has a first string channel cross-section which is not circular, wherein the first string channel cross-section can take different orientations relative to the string bed plane, and wherein in a first orientation relative to the string bed plane the first string channel cross-section allows a smaller string deflection perpendicular to the string bed plane than in a second orientation relative to the string bed plane.

Apart from, e.g., elliptical, rectangular, racetrack-shaped or similar cross-sections, this can also be achieved in that the first string channel cross-section is discontinuous, i.e. in that the string channel projects further at some sites along the string passage direction than at other sites. At the sites that do not project further, such a cross-section should not be seen as a theoretical continuation of the remaining structure but as extending infinitely. For an otherwise round grommet with a string channel that partially projects in the string passage direction, the string channel cross-section would be a segment of a circle at the sites at which the string channel projects further, while it extends infinitely at the interrupted sites.

The string opening in the ball game racket frame can serve for passing through and attaching and/or for deflecting a string portion or a string. The grommet is provided in the string opening in such a manner that a string which is passed through the string opening extends through the string channel of the grommet. The string channel thus can also be referred to as through opening or through channel of the grommet. Preferably, a longitudinal axis of the string channel (said longitudinal axis essentially corresponding to the string passing direction, apart from small deviations) is congruent with the longitudinal axis of the corresponding string portion in the string bed. However, the longitudinal axis of the grommet can also be arranged within the string bed plane in a manner inclined with respect to the longitudinal axis of the corresponding string portion in the string bed, i.e. the longitudinal axis of the grommet can be rotated relative to the longitudinal axis of the corresponding string portion about an axis perpendicular to the string bed plane.

The string channel of the grommet has a first string channel cross-section. The string channel cross-section is the section through the string channel which extends through the channel perpendicularly with respect to the longitudinal axis of the string channel. The string channel cross-section is preferably not circular, i.e. not round. In this connection, the invention should be understood such that the shape of the string channel cross-section deviates from circularity in a dedicated, intended manner (and does not deviate marginally in a manner caused by wear). Preferably, a non-circular string channel cross-section means a string channel cross-section in which the ratio of maximum extension to minimum extension is at least 1.2, preferably at least 1.5, more preferably at least 1.8 and particularly preferably at least 2.

Preferably, the grommet and/or the ball game racket frame is/are configured such that the first string channel cross-section can take different orientations relative to the string bed plane. In this context, "orientations" means in particular rotational orientations, i.e. orientations that the string channel cross-section can take by rotation about a longitudinal axis of the string channel or an axis perpendicular to the string channel cross-section (i.e. an axis in or parallel to the string bed plane). Thus, it can be intended that the string channel cross-section can change its orientation by rotating about a longitudinal axis of the string channel or an axis perpendicular to the string channel cross-section. Preferably, the string channel cross-section can take at least two orientations relative to the string bed plane. However, also at least three, at least four, at least six and/or more orientations are conceivable. Preferably, the string channel includes the point of the ball game racket frame at which, in a viewing direction along the string from the string bed in the direction towards the grommet, the corresponding string contacts the frame first. This point can also be called contact and/or deflection point. Each string portion within the string bed extends between two such deflection points, wherein the two deflection points are located at different sites of the frame. A special case can be strings that are not deflected but attached to and/or against the frame, for example by a knot in the string, for example by a knot outside the frame, which is common in the art. In such a case, the deflection point must be defined as the point at which, although not being deflected, the string is in contact with the frame.

In a first approach, the individual string portions which form the transverse and longitudinal strings of the stringing can be described as individual strings that are respectively mounted between the corresponding two deflection points. When a ball hits the stringing of a ball game racket, the hit string is deflected out of its rest position. Assuming that the ball hits the string bed plane perpendicularly, the hit string is deflected perpendicularly with respect to the string bed plane. Since the string channel preferably has a slightly larger diameter than the string that is passed through it, a sufficiently strong deflection of the hit string might lead to a displacement of the deflection point. Depending on the stringing pattern and the grommet geometry, a deflection of the string might cause the deflection point to be displaced or newly formed at the grommet when the string is deflected out of the string bed plane. According to the invention, the string channel has a string channel cross-section that is not circular. Preferably, the string channel cross-section can be oriented relative to the string bed plane or the ball game racket frame in such a manner that, in a first orientation (i.e. position) of the string channel cross-section in a perpendicular direction relative to the string bed plane, the string can be deflected further within the string channel than in case the string channel cross-section is oriented in a second orientation relative to the string bed plane.

In particular, it is in accordance with the invention that a portion of the string that is freely vibrating within the string bed perpendicularly with respect to the string bed plane is shorter when the string channel cross-section takes the first orientation than when the string channel cross-section takes the second orientation.

In the present case, the freely vibrating portion is the string portion extending between two corresponding deflection points. In other words, the deflection points of a string portion are preferably closer together when the string channel cross-section takes the first orientation than when the string channel cross-section takes the second orientation.

In a preferred embodiment of the ball game racket frame, the first string channel cross-section is elongate, for example slot-shaped and/or elliptical.

Because of the slot shape or elliptical shape of the string channel cross-section, it has a long axis and a short axis. If, in a first orientation, the short axis is oriented perpendicularly with respect to the string bed plane, the passed-through string can be deflected in the area of the grommet perpendicularly with respect to the string bed plane by maximally the amount of the short axis. If, however, in a second orientation, the string channel cross-section is oriented with the long axis being perpendicular with respect to the string bed plane, the string extending through it can be deflected in the area of the grommet by maximally the amount of the long axis perpendicularly with respect to the string bed plane.

Alternatively or additionally, the first string channel cross-section can also have other shapes, for example, asymmetrically rectangular, asymmetrically polygonal, asymmetrically star-shaped, and/or any other geometrical shape that is asymmetrical with respect to rotation.

In a ball game racket frame according to the invention, the string channel can have a second string channel cross-section that is different from that of the first string channel and is preferably circular, wherein the first string channel cross-section preferably merges continuously into the second string channel cross-section. However, the second string channel cross-section can also have generally suitable non-circular cross-sections, for example one of the cross-sectional shapes already mentioned in connection with the first string channel cross-section. The difference between the two string channel cross-sections can alternatively or additionally be in one or more of the dimensions of the cross-sections. For example, both string channel cross-sections can be elliptical but can differ from each other with respect to the values of their long and short semi-axes.

Preferably, the grommet is then inserted in the string channel of the frame in such a manner that the first string channel cross-section is closer to the string bed relative to the second string channel cross-section.

In a ball game racket frame according to the invention, preferably a smallest extension of the first string channel cross-section corresponds to the diameter of the second, round string channel cross-section.

In a ball game racket frame according to the invention, preferably a smallest extension of the first string channel cross-section is oriented perpendicular with respect to the string bed plane in the first orientation and/or a largest extension of the first string channel cross-section is oriented perpendicular with respect to the string bed plane in the second orientation. In this context, the position of the first orientation corresponds to a smallest possible deflection of the string in the area of the grommet perpendicular with respect to the string bed plane and a position of the string channel cross-section in the second orientation corresponds to a largest possible deflection of the string in the area of the grommet.

Preferably, the first and the second orientation of the string channel cross-section are at an angle of 90° relative to one another. This means that for changing between the first orientation and the second orientation of the string channel cross-section, the string channel cross-section must be rotated by 90°, preferably about an axis perpendicular with respect to the cross-section.

In a preferred embodiment of the ball game racket frame, the grommet comprises a means for preventing rotation of the grommet as a whole relative to the ball game racket frame. Thus, it is in particular prevented that the position of the grommet as a whole and thus possibly also of the string channel cross-section changes, for example rotates, unintentionally. Such an unintended rotation might lead to an unintended change of the vibration characteristics.

Therefore, it is in particular preferred that the grommet has, at least in sections, a non-circular outer circumference which can be inserted into an, at least in sections, corresponding recess in the ball game racket frame and/or in an, at least in sections, corresponding insert for the ball game racket frame. In case an insert is provided, the latter can be inserted into an, at least in sections, corresponding counterpart in the racket frame.

The grommet can have, for example, a rectangular, square, polygonal, elliptical and/or irregular outer circumference. Respective counterparts can be considered for the, at least in sections, corresponding recess in the ball game racket frame and/or in an insert intended for this purpose. Due to the non-circular outer circumference of the grommet having an, at least in sections, corresponding recess in the frame and/or an, at least in sections, corresponding insert, undesired rotation of the grommet as described above is prevented.

It is preferred that a means for protecting the grommet from falling out in the non-stringed state is present between the string opening and the grommet inserted into the string opening, either directly or indirectly by the interposed insert. In the stringed state, such a protection from falling out might be unnecessary when the grommets are placed, e.g., from outside onto the racket frame, because the grommets are then held in place by the stringing. Nevertheless, such protection from falling out also makes sense when the grommets are attached to the racket frame from outside because this facilitates the handling of the racket in the non-stringed state and/or during stringing to such an extent that the grommets cannot unintentionally fall out of the racket frame. Such protection from falling out can be realized in many known manners, for example, in that an outer diameter of the grommet is adapted, at least in sections, to an inner diameter of the corresponding string channel so that the friction between the grommet and the string channel is sufficiently high for preventing the grommet from falling out of the string channel. Alternatively or additionally, the grommet can be stuck to the frame by means of a snap-in and/or clip connection.

The grommet preferably has a thickening which prevents the grommet from slipping through the string opening in the ball game racket frame. The thickening can comprise the non-circular outer circumference of the grommet.

In a preferred embodiment of the ball game racket frame, the grommet comprises a first grommet portion and a second grommet portion which can be connected by means of a slip-on connection, preferably a lockable slip-on connection, wherein the first grommet portion preferably has the first string channel cross-section.

Preferably, the slip-on connection between the first grommet portion and the second grommet portion can be released only by damaging the first and/or the second grommet portion. In this case, the slip-on connection preferably serves for combining the two grommet portions after their separate production. Preferably, the two grommet portions can be attached to the frame from two opposite sides, i.e. one grommet portion from a first side and the other grommet portion from a side opposite to the first side of the ball game racket frame. Preferably, the first or the second side is the side of the frame facing the string bed, which also receives the strings extending from the string bed. When the two grommet portions are accordingly shaped—both string portions can each have a shape which prevents the grommet portion from being movable completely through the string opening—the put together grommet rests firmly in the frame and cannot fall out any more.

In a preferred embodiment of a ball game racket frame according to the invention, the first grommet portion can be rotated relative to the second grommet portion. In this context it is stressed that such a rotation can also be possible when the slip-on connection between the first grommet portion and the second grommet portion is of the kind that can only be released by damaging the first and/or the second grommet portion. An example thereof is a rotary lock-in connection.

Preferably, the second grommet portion is fixed in and/or at the ball game racket frame. For this purpose, all suitable techniques can be used, for example, bonding, pressing, welding, screwing, nailing, locking and the like as well as combinations thereof. When the first grommet portion can additionally be rotated relative to the second grommet portion, this results in the first grommet portion being rotatable relative to the ball game racket frame.

Preferably, the first grommet portion can be locked in different rotational positions relative to the second grommet portion. Particularly preferably, the first grommet portion can be locked relative to the second grommet portion in two rotational positions which preferably enclose an angle of 90° relative to one another.

Preferably, the first grommet portion is locked in different rotational positions relative to the second grommet portion by means of one or more lock-in connections.

An embodiment of a ball game racket frame according to the invention can comprise a grommet strip and the grommet or the second grommet portion can be formed integrally, preferably as one piece, with the grommet strip.

Alternatively or additionally, a change in the vibration properties by means of a rotatable grommet can also be realized in that the grommet comprises sections of different materials at an inner wall of the string channel in the areas in which there is or can be contact with the string. The different materials preferably have different mechanical characteristics, in particular in view of friction and dampening, so that the string is influenced in different manners in view of its vibration behavior, depending on the materials with which it is or can come in contact when a ball hits the string. In this option of the rotatable grommet, no non-circular string channel cross-section is necessary.

In an embodiment of the grommet with different materials, the, in sections, different materials of the grommet are arranged such that, when being deflected upon contact with the ball, the string comes in contact with a first material of the grommet when the grommet is in a first orientation relative to the string bed plane, and, when being deflected upon contact with the ball, the string comes in contact with a second material of the grommet when the grommet is in a second orientation relative to the string bed plane. For example, the grommet can have a round cross-section which is divided in four segments of equal size. Two first segments, which face each other, comprise the first material and two second segments, which face each other, comprise the second material. When the grommet is oriented such that an angle bisector of the first segments is oriented perpendicularly with respect to the string bed plane, the string thus comes/is in contact with the first material when being deflected. When the grommet is oriented such that an angle bisector of the second segments is oriented perpendicularly with respect to the string bed plane, the string thus comes/is in contact with the second material when being deflected.

Preferably, the first material and the second material have different coefficients of sliding friction and/or coefficients of static friction relative to the material of the string. Preferably, the coefficient of sliding friction and/or the coefficient of static friction of the first and second materials differ by at least 20%, more preferably by at least 50% and particularly preferably by at least 100% (in each case relative to the smaller coefficient).

For example, polyether block amide block copolymers (trade name: Pebax) having different Shore hardnesses can be used for the first and the second material. In particular also polyoxymethylene is suitable as material having the lower coefficient of friction.

In a grommet according to the invention, the grommet can, in sections, allow a play of the string, so that when being deflected the string comes in contact with the grommet material while in a rest position it is, at least in sections, not in contact with the grommet material. A grommet according to the invention also can have no such at least sectional deflection play, or also deflection clearance, in particular in case it is a grommet comprising different materials.

The grommet according to the invention and/or the grommet strip according to the invention can be produced by using any production process that is known for this purpose, in particular by injection molding and/or 3D printing.

In the following, the invention will be described in more detail on the basis of the Figures in which FIG. 1A shows a schematic perspective view of a grommet according to the invention;

Figure 1A:
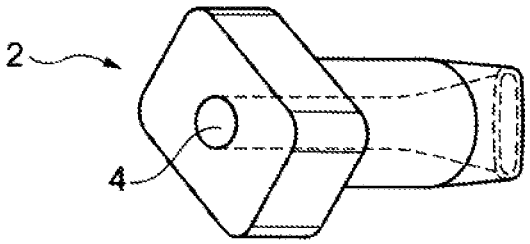
FIG. 1B shows a longitudinal section through the grommet of FIG. 1A.
FIG. 1C shows the grommet of FIGS. 1A and 1B in a further perspective view.
FIG. 1D shows an embodiment of the first string channel cross-section.
FIG. 1E shows an embodiment of the second string channel cross-section.
Figure 1B:
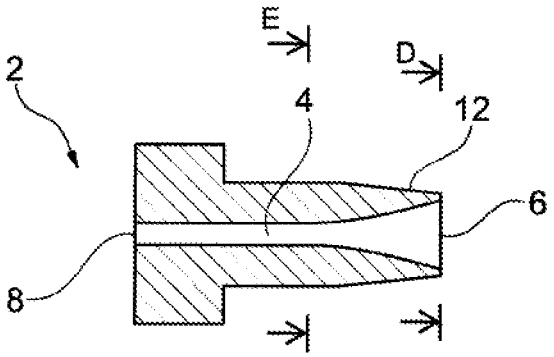
Figure 1C:
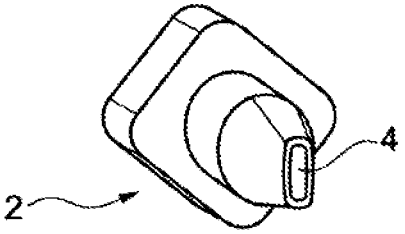
Figure 1D:
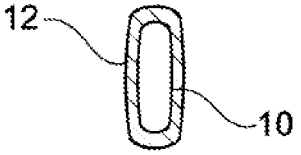

FIGS. 1A to 1C show a grommet according to the invention. As shown, it can be formed as one piece. Preferably, it comprises a plastic material, for example injection moldable and/or 3D printable plastics such as polyamide 6.6, polyamide 11.12 and thermoplastics such as polyether block amide block copolymers (trade name: Pebax). The grommet 2 comprises a string channel 4 for passing a string through it. FIG. 1A shows the grommet 2 in a perspective view from obliquely outside, whereas FIG. 1C shows the grommet 2 in an inclined perspective view from obliquely inside, wherein outside and inside relate to the arrangement in a ball game racket frame according to the invention described further below. FIG. 1B shows the grommet 2 of FIGS. 1A and 1C in a longitudinal section. The string channel 4 extends from an inner string channel opening 6 to an outer string channel opening 8. In its course from the inner string channel opening 6 to the outer string channel opening 8, the string channel 4 can have a plurality of different cross-sectional shapes and/or cross-sectional diameters. The grommet 2 according to the invention, however, has at least one first string channel cross-section 10 (see FIG. 1D), for example the string channel cross-section 10 at the inner string channel opening 6. A preferred embodiment of the first string channel cross-section 10 is shown in FIG. 1D. The shape of the first string channel cross-section 10 is preferably elliptical and/or slot-shaped, this means that the first string channel cross-section preferably has an elongate shape. For a better orientation, not only the first string channel cross-section 10 is shown but also an outer wall 12 of the grommet is shown. The outer wall 12 preferably extends essentially parallel with respect to the first string channel cross-section 10, this means that the shape of the outer wall 12 is similar to the shape of the first string channel cross-section, but larger. Thus, not only material and thus weight can be saved, the elongate shape of the outer wall 12 of the grommet 2 in the area of the first string channel cross-section 10 can also be used as orientation aid for the user who can thus notice more easily in which position the grommet 2 is. Alternatively, the first string channel cross-section 10 can have any desired other shape which has a first diameter that is larger than a second diameter. Examples thereof are rectangular, polygonal, rhombic, star-shaped, cross-shaped and/or irregular shapes. In particular, the first string channel cross-section 10 is preferably not circular.

Figure 1E:
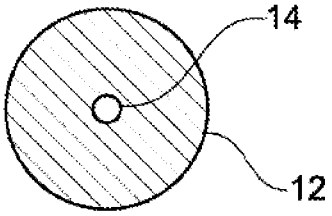

The string channel 4 preferably has a second string channel cross-section 14 being different from the first string channel cross-section 10. Preferably, the second string channel cross-section is circular, as shown in FIG. 1E. However, the second string channel cross-section 14 can basically have the shapes already described in connection with the first string channel cross-section 10. Preferably, the extension of the first string channel cross-section 10 in the directions that may be perpendicular with respect to the string bed plane (which will be explained in more detail below) is larger than the corresponding extension of the second string channel cross-section. Preferably, the first string channel cross-section 10 gradually merges into the second string channel cross-section 14, and the string channel 4 preferably tapers from the first string channel cross-section 10 continuously to the second string channel cross-section 14. The three-dimensional shape of the string channel 4 from the first string channel cross-section 10 to the second string channel cross-section 14 thus can correspond to a funnel that is "pressed flat" in one direction.

Figure 2A:
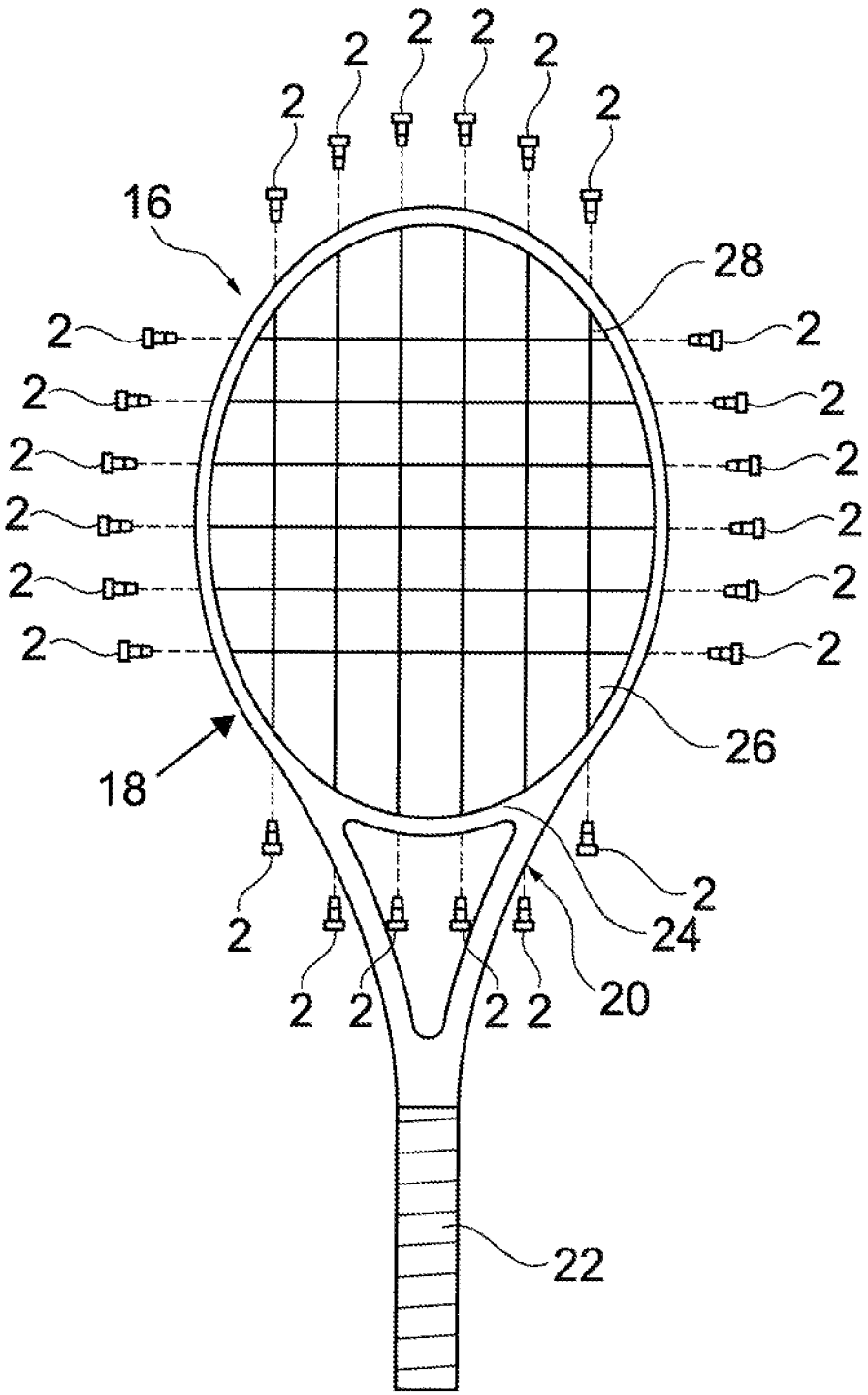
FIG. 2A shows a schematic view of a ball game racket frame according to the invention.

The grommet 2 is preferably inserted in a ball game racket frame 16 according to the invention (see FIG. 2A) in such a manner that the first string channel cross-section 10 is arranged closer to the string bed relative to the second string channel cross-section 14. This means that the first string channel cross-section 10 is arranged further inwardly relative to the second string channel cross-section 14. The arrangement of a grommet 2 according to the invention in a ball game racket frame 16 according to the invention is explained in more detail on the basis of FIGS. 2 and 3. FIG. 2A schematically shows a ball game racket frame 16 according to the invention with a racket head 18, a racket heart 20 and a handle 22. The racket heart 20 can consist of two bars and a bridge 24, wherein the bridge 24 closes the string bed 26 in the area of the racket heart 20. The structure shown here corresponds to a structure that is common in the art, but it should by no means be considered as being restrictive. Along the circumference of the racket head 18, including the bridge portion 24 and optionally the two bars of the racket heart 20, preferably a plurality of grommets 2 is provided, wherein each grommet 2 is configured to be inserted in a corresponding string opening of the ball game racket frame 16. The number of grommets 2 shown in FIG. 2A is only meant exemplarily. Here, two times six grommets 2 are shown for six longitudinal strings 28 and for six transverse strings each. The ball game racket frame 16 according to the invention can of course have two grommets 2 per longitudinal string 28 and/or two grommets 2 per transverse string. The numbers and the positions of the longitudinal and transverse strings as well as the corresponding grommets 2 are selected in accordance with the desired stringing pattern. The shown stringing pattern comprises longitudinal strings 28 which extend essentially parallel with respect to the longitudinal axis of the ball game racket frame as well as transverse sides being essentially perpendicular thereto. However, alternatively or additionally, the stringing pattern can comprise a longitudinal and/or a transverse string which differ(s) from the shown angles relative to the longitudinal axis. For example, the longitudinal strings 28 can be arranged in a fan-shaped manner. The dashed lines in FIG. 2A indicate where the grommets 2 should be inserted into the string openings of the ball game racket frame 16.

Figure 2B:
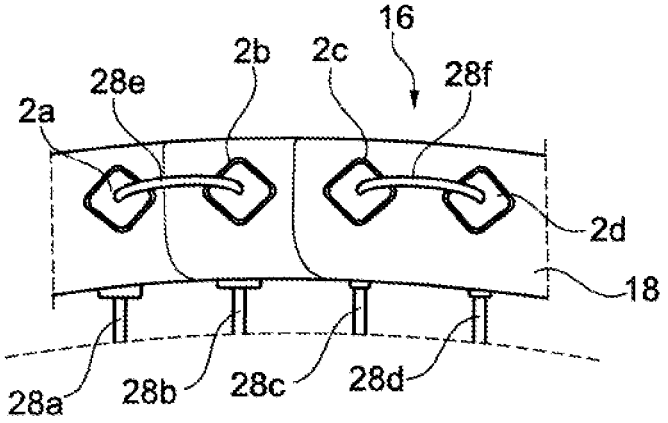
FIG. 2B shows a detail of an area of the ball game racket frame of FIG. 2A in a perspective view.

FIG. 2B shows a schematic detailed view of a portion of the ball game racket frame 16 shown in FIG. 2A with four inserted grommets 2. A portion of the racket head 18 is shown. As shown in FIG. 2B, the individual longitudinal strings 28*a* to 28*d* can be formed in that a relatively long string piece is passed through a first grommet 2*a* from the string bed through the frame 16 outwardly, is then passed along an outer circumference of the frame 16 as string portion 28*e* to the second grommet 2*b*, is then passed through the string channel 4 of the grommet 2*b* again inwardly into the string bed 26 where the string 28 then forms the next longitudinal string portion 28*b*. The same analogously applies to the string portions 28*c* and 28*d*, which are formed in that a relatively long string piece is passed from the string bed plane 26 through the grommet 2*c* outwardly to the outer side of the frame 16 where the relatively long string piece is passed to the grommet 2*d* and thus forms the string portion 28*f*, and is then passed through the grommet 2*d* again through the frame 16 to the inner side of the frame 16 and into the string bed 26 where the string forms the string portion 28*g*. The same analogously applies to a preferred formation of the transverse strings. In this case, the transverse strings can be formed preferably by a first long string piece and the longitudinal strings 28 can be formed preferably by a second long string piece. Alternatively to the option shown here, all string portions of the string bed can be formed by one single long string, or alternatively by more than two string pieces. For example, a longitudinal string 28 can be formed by one single string piece which is secured outside the two corresponding grommets 2 by a respective knot. Other securing techniques, for example clamping, are also conceivable.

Figure 2C:
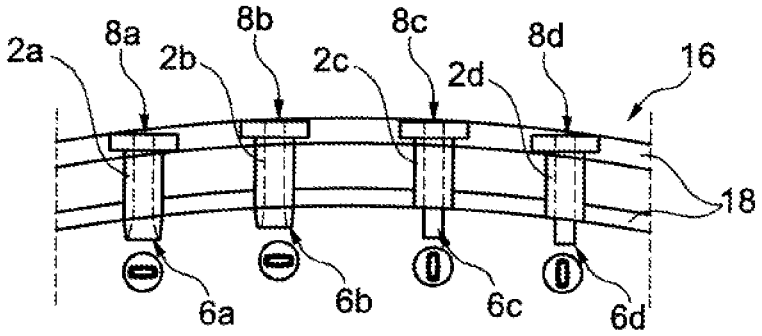
FIG. 2C shows the area shown in FIG. 2B in a cross-sectional view.

FIG. 2C shows the detailed view of FIG. 2B as a section congruently to the string bed plane. The lower area of FIG. 2C additionally shows the positions of the individual grommets 2, i.e. the view of the grommets 2 viewed along the strings from inside outwardly is shown. As shown, the grommets 2*a* to 2*d* are preferably arranged each with the corresponding string channel openings 8*a* to 8*d* on the outer side of the racket frame 16 and with the string channel openings 6*a* to 6*d* on the inner side of the frame 16. The course of the string channels 4 inside the grommets 2*a* to 2*d* is indicated by dashed lines.

Preferably, the grommet 2 can take two positions relative to the ball game racket frame 16. In FIG. 2C, the two grommets 2*a* and 2*b* are shown in a first orientation relative to the string bed plane, while the two grommets 2*c* and 2*d* are shown in a second orientation relative to the string bed plane. In the first orientation relative to the string bed plane, the grommet 2*a, b* according to the invention preferably allows a smaller deflection of a string perpendicularly with respect to the string bed plane than in the second orientation, wherein this relates to the string portion which extends through the grommet 2 according to the invention. The grommets 2*a* to 2*d* of the invention as shown in FIG. 2C have a slot-shaped first string channel cross-section 10 which merges into a round second string channel cross-section 14. The slot-shaped first string channel cross-section allows in its longitudinal direction a larger string deflection than in its transverse direction. When the grommet 2 is inserted into the racket frame 16 in such a manner that the long extension of the first string channel cross-section 10 is oriented parallel with respect to the string bed plane, this corresponds to the first orientation in which the passed-through string can be deflected in the area of the grommet 2 only as much out of its rest position perpendicularly to the string bed plane as this is allowed by the short extension of the slot-shaped first string channel cross-section. Instead of "extension", also "axis" can be used. When, however, the grommet 2 is inserted into the ball game racket frame 16 in such a manner that the long extension of the first string channel cross-section 10 is oriented perpendicularly with respect to the string bed plane, this corresponds to the second orientation of the grommet 2 relative to the string bed plane in which the passed-through string can be deflected as much as this is allowed by the long extension of the first string channel cross-section 10.

Preferably, the first orientation of the grommet 2 relative to the string bed 26 and the second orientation of the grommet 2 relative to the string bed 26 enclose an angle of 90° with each other, this means that in order to bring the grommet 2 from one orientation into the other orientation, the string channel cross-section 10 must be rotated by 90°. Alternatively, the two orientations of the first string channel cross-section 10 can also enclose other angles with each other. This is preferable in particular when the grommet 2 cannot take only two orientations relative to the string bed plane but more, for example three, four or more orientations.

As already mentioned, the grommet 2 according to the invention is preferably inserted into the ball game racket frame 16 according to the invention. The shape of the grommet 2 and the shape of the corresponding opening for passing the string through the frame 16 preferably correspond to each other in such a manner that the grommet 2 preferably can be inserted into the, at least in sections, corresponding opening in the frame 16 without additional tools being necessary. Preferably, however, a friction is caused between the grommet 2 and the opening in the ball game racket frame 16 which is sufficient for guaranteeing that the grommet 2 is held in the frame 16 by the frictional force even when the frame 16 is not stringed. This facilitates the handling of the racket frame 16 in the non-stringed state, in particular during stringing, because the grommets 2 cannot unintentionally fall out of the, at least in sections, corresponding openings in the frame 16.

Figure 3:
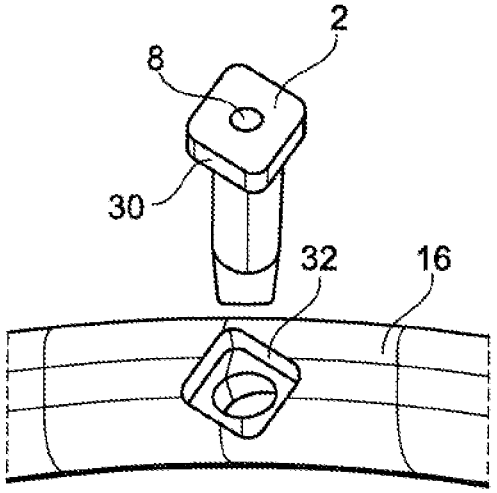
FIG. 3 shows a schematic detailed view of a ball game racket frame according to the invention and a grommet according to the invention.

FIG. 3 shows a preferred embodiment of the grommet 2 and an opening in a ball game racket frame 16 which corresponds thereto at least in sections. As shown in FIG. 3, the grommet 2 can have a portion 30 whose outer circumference has a non-circular shape. The non-circular portion 30 preferably fits in a recess 32 in the ball game racket frame 16 which corresponds thereto at least in sections. The recess 32 can also be referred to as seat 32. The non-circular shape of the outer circumference of the portion 30 of the grommet 2 and the, at least in sections, corresponding seat 32 in the ball game racket frame 16 preferably provide for a protection against rotation of the grommet 2. The possible insertion positions of the portion 30 into the recess 32 correspond to the orientations which the first string channel cross-section 10 can take relative to the string bed plane. For example, the portion 30 and/or the seat 32 can have an essentially rectangular, square, polygonal, star-shaped, cross-shaped and/or irregular shape of the outer circumference and/or the, at least in sections, corresponding inner circumference.

Alternatively or additionally, the grommet 2 can have a portion which is thickened as compared to the remainder of the grommet 2. In the example of the grommet 2 of FIG. 3, the thickened portion corresponds to the non-circular portion 30 for protection against rotation. However, the two portions can also be provided independently of one another at the grommet 2. The thickened portion preferably serves for protecting the grommet 2 against slipping through the frame from outside inwardly. Such a slipping-through protection is not only advantageous in connection with the handling of the ball game racket frame 16 during stringing, but it also guarantees that the grommet does not slip through the frame when the ball game racket is used for playing so that the playing behavior of the racket is affected.

Figure 4:
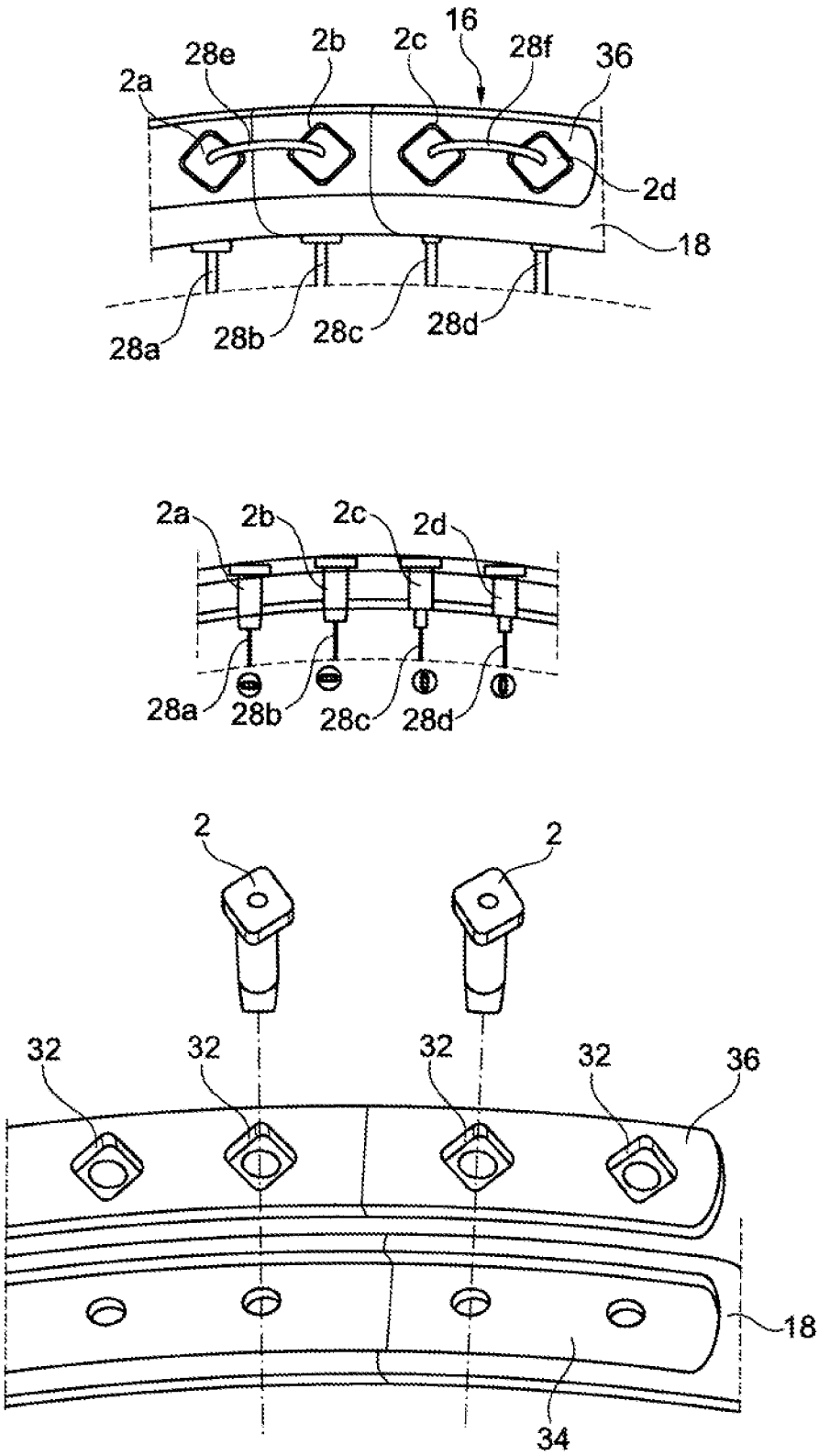
FIG. 4 shows a schematic detailed view of a frame according to the invention, an insert according to the invention and grommets according to the invention.

As shown in FIG. 4, it is not necessary that a grommet 2 according to the invention is inserted directly into a ball game racket frame. It is also possible to interpose an insert 36 intended for this purpose. FIG. 4 shows a head portion 18 of a ball game racket frame which has a recess 34. The recess 34 has, at least in sections, a shape that corresponds to the insert 36. Preferably, the insert 36 is held in the recess 34 by friction and/or by a clip and/or lock-in mechanism. The insert 36 in turn preferably comprises recesses 32 which, at least in sections, correspond to the grommets 2 according to the invention. Thus, the grommets 2 can be inserted in the, at least in sections, corresponding insert 36 and thus combined already in advance to a grommet strip. Alternatively or additionally, it is also possible that the insert 36 is first placed in the recess 34 of the ball game racket frame 16 and the grommets 2 are inserted subsequently. The order is not limiting in this regard. Preferably, in this embodiment the orientation of the first string channel cross-section 10 of the grommet 2 relative to the string bed is caused by correspondingly rotating the individual grommet relative to the string bed plane, while it is not necessary to change the orientation of the insert 36 relative to the string bed plane for this purpose.

If it is intended to transfer the grommet 2 according to the invention from the first orientation into the second orientation, the grommet 2 is preferably removed from the ball game racket frame or the insert 36 at least partly, the orientation of the first string channel cross-section 10 relative to the string bed plane is changed from the first into the second orientation, preferably by rotating the grommet 2 about an axis through the string channel 4, and the grommet 2 is again inserted in the, at least in sections, corresponding recess 32 in the ball game racket frame 16 or the insert 36. This is preferably done in the non-stringed state.

Figure 5A:
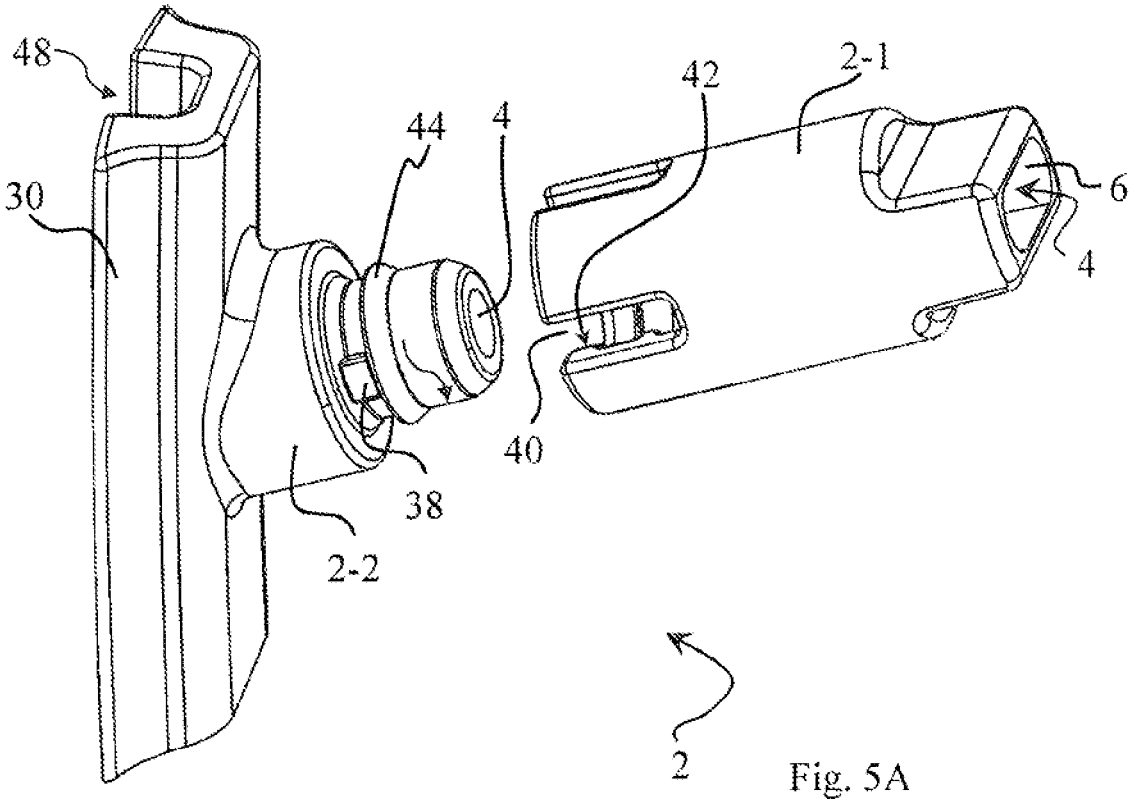
FIG. 5A shows a schematic view of a grommet according to the invention.

FIG. 5A shows a further embodiment of a grommet according to the invention. It is formed of two pieces. The grommet 2 of FIG. 5A comprises a first grommet portion 2-1 and a second grommet portion 2-2. Preferably, the first grommet portion 2-1 has the first string channel cross-section 10, as shown in FIG. 5A. In the shown example, the first string channel cross-section 10 corresponds, e.g., to the cross-section of the first grommet portion 2-1 at the inner string channel opening 6. Also in this grommet 2, a string channel 4 extends from the inner string channel opening 6 to the outer string channel opening 8, which is hidden in the view of FIG. 5A.

Figure 5B:
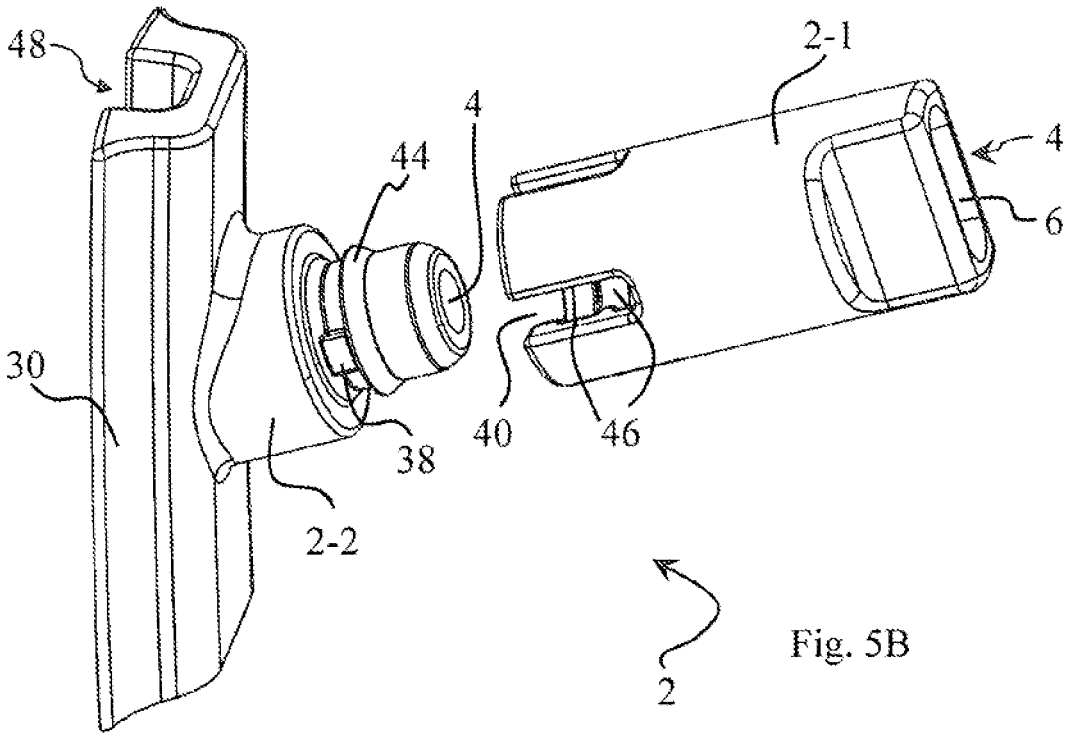
FIG. 5B shows the grommet of FIG. 5A in a different position.

Preferably, the first grommet portion 2-1 can take at least two different positions relative to the second grommet portion 2-2. A first position is shown in FIG. 5A, while FIG. 5B shows a second position of the first grommet portion 2-1 relative to the second grommet portion 2-2. This is clearly evident from the orientation of the first string channel cross-section 10 at the inner string channel opening 6. In the shown example, the string channel cross-section 10 is an elongate shape with two parallel, straight longitudinal sides which are connected with each other by circular lines. This is a generally possible shape of string channel cross-sections 10, 14.

Figure 5C:
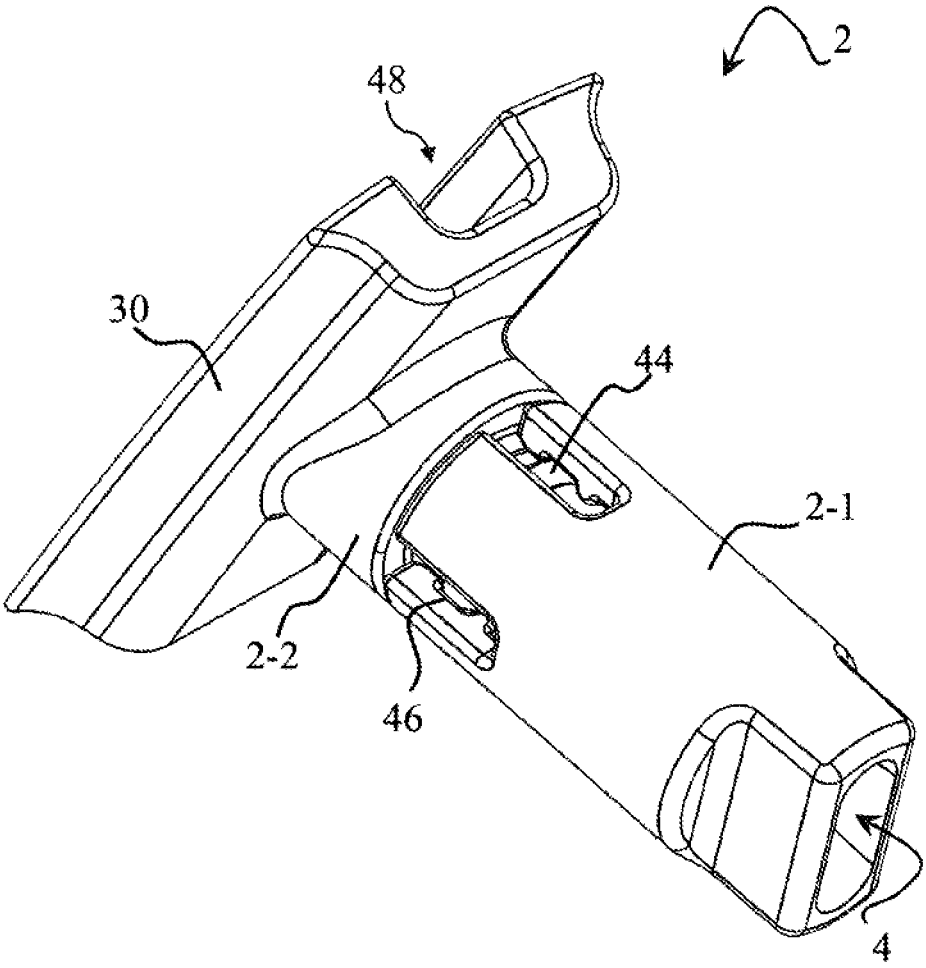
FIG. 5C shows the grommet of FIGS. 5A and 5B in the put together state.

Preferably, the first grommet portion 2-1 and the second grommet portion 2-2 can be combined, preferably by a clip connection, a lock-in connection or the like. In a preferred embodiment, once they are connected with each other, the first grommet portion 2-1 and the second grommet portion 2-2 can no longer be separated from each other without damaging at least one of the two parts, i.e. the first grommet portion 2-1 and/or the second grommet portion 2-2. This simplifies the production of the two parts, but at the same time guarantees that the two grommet portions 2-1, 2-2 are placed correctly relative to one another during use and/or the individual grommet portions 2-1, 2-2 less likely get lost. In FIGS. 5A to 5C, such a final locking is formed by the lock-in nose 44 which, in the present example, extends along the entire circumference of the second grommet portion 2-2. The lock-in nose 44 can be configured to extend, at least in sections, in a corresponding recess and/or cavity 46 in an inner wall of the string channel 4. This preferably causes the separation-proof lock-in connection. Alternatively or additionally, any other lock-in mechanism can be used, for example a lock-in nose on the first grommet portion 2-1 in combination with a further lock-in nose on the second grommet portion 2-2.

Preferably, the first grommet portion 2-1 can be locked in different positions, preferably rotational positions, relative to the second grommet portion 2-2, wherein the different positions of the first grommet portion 2-1 relative to the second grommet portion 2-2 each correspond to the different orientations of the first string channel cross-section 10 relative to the string bed plane. Locking can be realized by any suitable technique, in particular by a lock-in connection. For example, the second grommet portion 2-2 can comprise a lock-in nose 38, while the first grommet portion 2-1 comprises a cavity 40, also called recess 40, which corresponds thereto at least in sections and which is configured to engage with the lock-in nose 38. The lock-in nose 38 can also be present at the first grommet portion 2-1 and the cavity 40 at the second grommet portion 2-2. The number of lock-in noses 38 as well as recesses 40 on the second or first grommet portion 2-1, 2-2 is adapted to the number of necessary orientations of the first string channel cross-section 10 relative to the string bed plane. In case there are two possible orientations of the first string channel cross-section, at least one lock-in nose 38 and two cavities 40 are provided, preferably, however, two lock-in noses which can engage four cavities 40 are provided, but it is also possible that three lock-in noses 38 and four cavities 40 are provided, in particular four lock-in noses and four cavities 40, or more. In order to guarantee rotation of the first grommet portion 2-1 relative to the second grommet portion 2-2 with at the same time guaranteeing a sufficient stability of the first grommet portion 2-1, an inner wall of the string channel 4 can have circumferential cavities 42 which connect the cavities/recesses 40. The circumferential cavities 42 serve for providing sufficient space for the lock-in noses 38 being able to extend along them therein when the first grommet portion 2-1 is rotated relative to the second grommet portion 2-2. This prevents a too wide spreading of a wall of one of the grommet portions, here the first grommet portion 2-1, during rotation. This is advantageous in particular in case the protection from rotation is used in combination with a final lock-in connection which prevents a renewed separation of the first grommet portion 2-1 from the second grommet portion 2-2 without damage (see above description). For adjusting the two-part grommet of FIGS. 5A to 5C, the first grommet portion 51 is rotated in the slipped-on state (see FIG. 5C) by overcoming the resistance of the lock-in noses 38 against the second grommet portion 22 from a first position into a second position. In these two locked-in positions, in the shown example of FIG. 5C the lock-in nose 38 rests in the cavity/recess 40.

In view of the lock-in connection which forms a connection of the two grommet portions 2-1 and 2-2 and the lock-in connection which forms a protection against rotation, it is stressed that the two lock-in connections and/or their functions can be realized in two separate lock-in mechanisms. However, they can also be realized in one single lock-in mechanism.

Preferably, the second grommet portion 2-2, as shown in FIGS. 5A to 5C, comprises a thickening 30, the function of which has already been described in connection with other embodiments. The thickening 30 can have a cavity 48 which serves for guiding the string along the outer circumference of the racket frame to the next grommet.

Also in the embodiment of FIGS. 5A to 5C it can be intended that the grommet 2 with the thickening 30 can be inserted directly in a recess 32 in the ball game racket frame 16 which corresponds thereto at least in sections. However, it is also possible that an insert 36 with, at least in sections, corresponding recess 32 is interposed, wherein the insert 36 in turn can be inserted into a recess 34 in the ball game racket frame which corresponds thereto at least in sections.

In a particularly preferred embodiment, the thickened portion 30 is part of a grommet strip comprising a plurality of grommets 2. This facilitates the insertion of grommets 2 into a ball game racket frame because the assignment of the grommets 2 to the corresponding string openings in the frame 16 is facilitated and a plurality of grommets 2 can be inserted simultaneously, i.e. in one operating step, into the frame 16, which saves much time both in the production process and in connection with later repair work and/or grommet change work.

Alternatively or additionally to the embodiments described above, a two-part grommet 2 can also be configured such that the first grommet portion 2-1 and the second grommet portion 2-2 can be put together and disconnected repeatedly without any tools and without being damaged. Alternatively or additionally to a rotation of the first grommet portion 2-1 relative to the grommet portion 2-2 against the resistance of the lock-in noses 38, the first string channel cross-section 10 can be transferred from the first into the second orientation in that the first grommet portion 2-1 is separated from the second grommet portion 2-2 in the first orientation, is then rotated into the second orientation as desired, wherein the rotated position corresponds to the newly desired orientation of the first string channel cross-section 10, and is subsequently slipped on the second grommet portion 2-2 in the second orientation.

Alternatively or additionally, a change in the vibration characteristics caused by a rotatable grommet 2 can also be realized in that the grommet 2 comprises sections of different materials at the inner wall of the string channel 4 in the areas in which there is or can be contact with the string. The different materials preferably have different mechanical characteristics, in particular in view of friction and dampening, so that the string is influenced in different manners in view of its vibration behavior, depending on the materials with which it is in contact. The arrangement of the different materials preferably corresponds to different orientations of the grommet 2 or the first grommet channel cross-section 10 relative to the string bed plane. For example, in the embodiment of FIGS. 5A to 5C, the two long parallel extending sides of the string channel can comprise a first material in the area of the first string channel cross-section and a second material in the circular portions of the string channel in the area of the first string channel cross-section 10.

The invention claimed is:

1. A ball game racket frame defining a string bed plane and comprising at least one string opening for receiving a string, wherein the string opening includes a grommet with a string channel, wherein the string channel has a first string channel cross-section which is not circular, wherein the first string channel cross-section can take different rotational orientations relative to the string bed plane, wherein, in a first orientation relative to the string bed plane, the first string channel cross-section allows a smaller string deflection perpendicularly with respect to the string bed plane than in a second orientation relative to the string bed plane, and wherein the grommet comprises a means for protecting the grommet from rotating as a whole relative to the ball game racket frame.

2. The ball game racket frame according to claim 1, wherein a portion of the string which is freely vibrating within a string bed perpendicularly with respect to the string bed plane is shorter when the first string channel cross-section takes the first orientation than when the string channel cross-section takes the second orientation.

3. The ball game racket frame according to claim 1, wherein the first string channel cross-section is slot-shaped and/or elliptical.

4. The ball game racket frame according to claim 1, wherein the string channel has a second string channel cross-section which is circular.

5. The ball game racket frame according to claim 4, wherein the smallest extension of the first string channel cross-section corresponds to the diameter of the second, circular string channel cross-section.

6. The ball game racket frame according to claim 4, wherein the first string channel cross-section merges continuously into the second string channel cross-section.

7. The ball game racket frame according to claim 1, wherein, in the first orientation, the smallest extension of the first string channel cross-section is oriented perpendicularly with respect to the string bed plane and/or, in the second orientation, the largest extension of the first string channel cross-section is oriented perpendicularly with respect to the string bed plane.

8. The ball game racket frame according to claim 1, wherein the first and the second orientations of the string channel cross-section enclose an angle of 90° relative to one another.

9. The ball game racket frame according to claim 1, wherein the grommet has, at least in sections, a non-circular outer circumference which can be inserted into a corresponding recess in the ball game racket frame and/or in an insert for the ball game racket frame.

10. The ball game racket frame according to claim 1, wherein the grommet comprises a first grommet portion and a second grommet portion which can be connected with each other by means of a slip-on connection.

11. The ball game racket frame according to claim 10, wherein the slip-on connection can only be released by damaging the first and/or the second grommet portion.

12. The ball game racket frame according to claim 10, wherein the first grommet portion can be rotated relative to the second grommet portion.

13. The ball game racket frame according to claim 12, wherein the second grommet portion is fixed in and/or at the ball game racket frame.

14. The ball game racket frame according to claim 12, wherein the first grommet portion can be fixed in different rotational positions relative to the second grommet portion.

15. The ball game racket frame according to claim 14, wherein fixing is realized by one or more lock-in connections.

16. The ball game racket frame according to claim 10, further including a grommet strip, wherein the grommet or the first grommet portion is formed integrally, as one piece, with the grommet strip.

17. The ball game racket frame according claim 1, wherein the ball game racket frame comprises a grommet strip.

18. The ball game racket frame according to claim 1, wherein the grommet comprises at least two sections, wherein each of the at least two sections includes a different material than the other of the two sections.

19. A ball game racket frame defining a string bed plane and comprising at least one string opening for receiving a string, wherein the string opening includes a grommet with a string channel, wherein the string channel has a first string channel cross-section which is not circular, wherein the first string channel cross-section can take different rotational orientations relative to the string bed plane, wherein, in a first orientation relative to the string bed plane, the first string channel cross-section allows a smaller string deflection perpendicularly with respect to the string bed plane than in a second orientation relative to the string bed plane, and wherein the string channel has a second string channel cross-section which is circular.

20. A ball game racket frame defining a string bed plane and comprising at least one string opening for receiving a string, wherein the string opening includes a grommet with a string channel, wherein the string channel has a first string channel cross-section which is not circular, wherein the first string channel cross-section can take different rotational orientations relative to the string bed plane, wherein, in a first orientation relative to the string bed plane, the first string channel cross-section allows a smaller string deflection perpendicularly with respect to the string bed plane than in a second orientation relative to the string bed plane, and wherein the grommet comprises a first grommet portion and a second grommet portion which can be connected with each other by means of a slip-on connection.

* * * * *